United States Patent [19]

Hirosaki et al.

[11] Patent Number: 4,666,319

[45] Date of Patent: May 19, 1987

[54] LABEL PRINTER

[75] Inventors: Yukihiro Hirosaki; Seiji Koike; Motonobu Hamada, all of Shizuoka, Japan

[73] Assignee: Tokyo Electric Co., Ltd., Tokyo, Japan

[21] Appl. No.: 753,781

[22] Filed: Jul. 11, 1985

[30] Foreign Application Priority Data

Jul. 16, 1984 [JP] Japan ..... 59-108157

[51] Int. Cl.[4] ..... B41J 3/00

[52] U.S. Cl. ..... 400/120; 101/288; 156/384; 156/584

[58] Field of Search ..... 101/288; 400/120; 156/277, 389, 540, 541, 584, DIG. 33, DIG. 47

[56] References Cited

U.S. PATENT DOCUMENTS 4,447,818 5/1984 Kurata et al. ..... 400/120 X 4,481,518 11/1984 Inui et al. ..... 400/120 X 4,490,206 12/1984 Makley ..... 101/288 X

*Primary Examiner*—Edgar S. Burr

*Assistant Examiner*—Moshe I. Cohen

*Attorney, Agent, or Firm*—Oblon, Fisher, Spivak, McClelland & Maier

[57] ABSTRACT

In a label printer of the invention, a guide member to guide an ink ribbon is positioned in reverse direction of separating direction of the ink ribbon with respect to the line connecting a platen to a point on the outside of a separating plane, and thereby the ink ribbon is separated in bent state from the ground paper and therefore the separation between the ground paper and the ink ribbon is performed well. In this constitution, vibration of the ground paper is prevented and the noise is not produced, and deformation of the ground paper is prevented and the feed amount is held uniform. Further the ground paper only is bent by the separating plate, and the label is separated securely.

6 Claims, 3 Drawing Figures

LABEL PRINTER

BACKGROUND OF THE INVENTION

1. Field of the Invention

The present invention relates to a label printer where a thermal head of thermal transfer system is used. 2. Description of the Prior Art FIG. 1 shows an example of a label printer in the prior art. In a cabinet 1 of the label printer, a long ground paper 3 with a label 2 stuck thereon is wound around a ground paper winding shaft 4. In order to perform printing on the label 2, the ground paper 3 is drawn and then wound around a platen 5 positioned to the front side of the ground paper winding shaft 4. In order to guide the ground paper 3 drawn out of the ground paper winding shaft 4 onto the platen 5, a guide plate 6 is installed between these members. After the label 2 is printed by a thermal head as hereinafter described, the label 2 is separated from the ground paper 3 by bending the ground paper 3 using a separating plate 7 positioned to the front side of the platen 5. The ground paper 3 after separating the label 2 is wound to a ground paper taking shaft 9 positioned below the separating plate 7. A guide roller 10 is installed to guide the ground paper 3 from the separating plate 7 to the ground paper taking shaft 9.

A ribbon winding shaft 12 with an ink ribbon 11 wound thereon is positioned to the rear side of the platen 5 in the cabinet 1. The ink ribbon 11 is drawn and overlaid to the ground paper 3 on the platen 5. A pair of guide rollers 13 are installed to guide the ink ribbon 11 between the ribbon winding shaft 12 and the platen 5. The ink ribbon 11 is heated by a thermal head 14 installed near the platen 5, and the ink is transferred in thermal transfer onto the label 2. In order to feed the ink ribbon 11 and the label 2, the platen 5 and a drive motor 15 positioned above the platen 5 are connected through a belt 16 that rotates the platen 5, and the fed ink ribbon 11 is wound to a ribbon taking shaft 17 installed above the platen 5. Guide rollers 18, 19, 20 are installed to guide the ink ribbon 11 which is wound to the ribbon taking shaft 17 and separated from the ground paper 3.

Referring to FIG. 3, the guide roller 18 positioned between the platen 5 and the separating plate 7 guides the ink ribbon 11 so as to separate the ground paper 3 and the ink ribbon 11 on a portion of the platen 5. Consequently, the ink ribbon 11 and the label 2 adhered by heat of the thermal head 14 cannot be easily separated. Furthermore, the ink ribbon 11 is rubbed and charged by the guide roller 18 during travelling. Since the guide roller 18 attracts the label 2 by the charging, separation between the ink ribbon 11 and the ground paper 3 becomes further difficult. The separation between the ink ribbon 11 and the ground paper 3 may occur abruptly, and therefore the ground paper 3 may be vibrated and noise be produced. The instantaneous feed amount of the ground paper 3 may increase, thereby possibly bending the label 2 itself at its top end together with the ground paper 3 by the separating plate 7 so that the label 2 cannot be separated.

OBJECTS OF THE INVENTION

A first object of the invention is to provide a label printer wherein an ink ribbon is easily separated from a ground paper with a label stuck thereon.

A second object of the invention is to reduce noise produced by vibration of the ground paper.

A third object of the invention is to hold the feed amount of the ground paper constant.

A fourth object of the invention is to separate the label securely.

Other objects of the invention will be apparent from the following description.

DESCRIPTION OF THE PREFERRED EMBODIMENT

Figure 1:
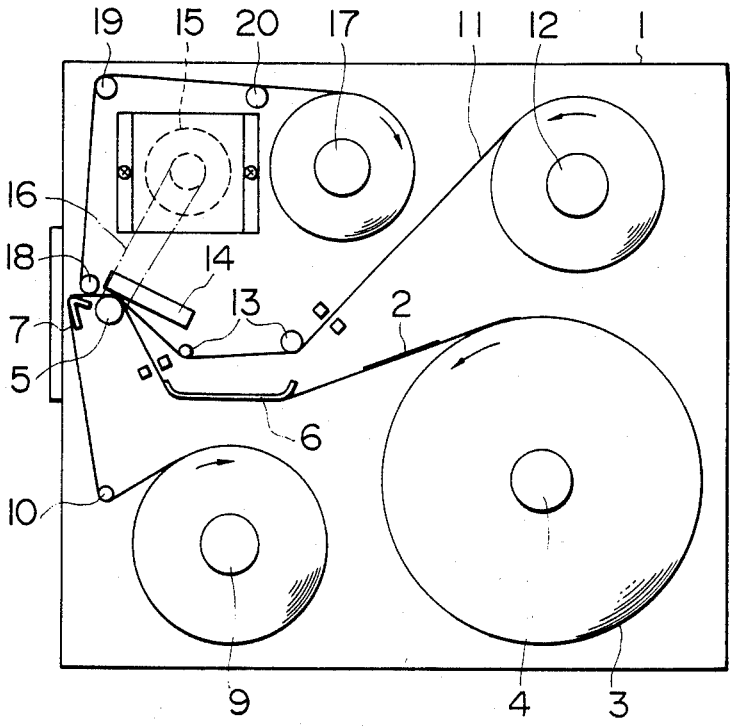
FIG. 1 PRIOR ART
FIG. 1 is a side view of a label printer illustrating whole constitution.
Figure 2:
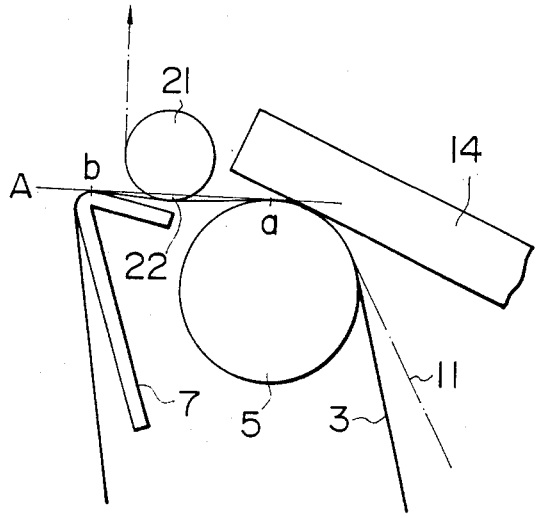
FIG. 2 is a side view of an embodiment of the invention.
Figure 3:
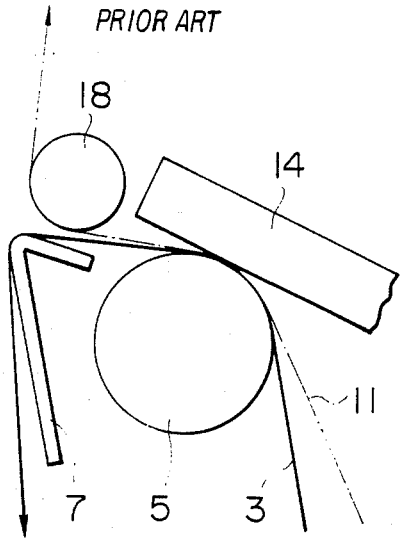
FIG. 3 PRIOR ART
FIG. 3 is a side view of a conventional example.

An embodiment of the invention will now be described referring to FIG. 2. Since the whole constitution of the embodiment is similar to that of FIG. 1, its description shall be omitted. Also, similar parts to those shown in FIG. 3 are designated by the same reference numerals, and their description shall be omitted. Thus different parts only will be described as follows.

The ink ribbon 11 is separated from the ground paper 3 at point (a) on the outer circumference of the platen 5 directed upwards, and a guide roller 21 positioned between the platen 5 and the separating plate 7 abuts on the ink ribbon 11 at an abutting portion 22 which is positioned lower than the line A connecting the point (a) to point (b) on upper side of edge portion of the separating plate 7. In this constitution, since the ground paper 3 is bent in pushed state by the abutting portion 22 between the platen 5 and the separating plate 7, the ink ribbon 11 and the label 2 are separated from each other smoothly when the ink ribbon 11 and the ground paper 3 are moved. Consequently, vibration of the ground paper 3 is prevented and the noise is not produced. Abrupt variation of the feed amount of the ground paper 3 caused by the abrupt separation is eliminated, and thereby the feed amount is held constant. Thus, only the ground paper 3 is bent by the separating plate 7, and the label 2 is separated securely.

Regarding material of the guide roller 21, it is made by molding of a charge eliminating material, for example, metal containing carbon. Since the static electricity of the ink ribbon 11 is eliminated, the label 2 is not attracted by the static electricity, but the ink ribbon 11 and the ground paper 3 are separated more smoothly, and influence of the charging is prevented even if the cabinet 1 encloses other parts.

According to the invention as above described, the guide member to guide the ink ribbon is positioned in reverse direction of the ribbon separating direction with respect to the line connecting the platen to the point on outside of the separating plate. Thereby the ink ribbon is separated in bent state from the ground paper, and the ink ribbon and the label are separated smoothly. In this constitution, vibration of the ground paper is prevented, and the noise is not produced. The ground paper is prevented from deformation caused by adhesion, and the feed amount of the ground paper is held constant, whereby the label is securely separated at the separating portion.

What is claimed is:

1. A label printer comprising:

(a) a ground paper having a first side and a second side, a plurality of labels being detachably mounted on the first side of said ground paper;

(b) a rotary platen;

(c) a separating plate located adjacent said rotary platen;

(d) first means for passing said ground paper over said rotary platen and around said separating plate with the first side of said ground paper facing away from said rotary platen and said separating plate;

(e) said separating plate being sized, shaped, and positioned so that said labels are separated from said ground paper as said ground paper passes around said separating plate;

(f) a thermal head located adjacent said rotary platen;

(g) an ink ribbon having a first side and a second side;

(h) second means for passing said ink ribbon between said rotary platen and said thermal head such that the first side of said ink ribbon makes planar contact with said plurality of labels on the first side of said ground paper;

(i) third means for rotating said rotary platen, thereby feeding said ground paper and said ink ribbon between said rotary platen and said thermal head;

(j) said ground paper separating from said rotary platen at a point "a" thereon and contacting said separating plate at a point "b" thereon; and (k) fourth means for causing the first side of said ground paper to assume a concave shape as it passes from the point "a" to the point "b" and for causing the first side of said ink ribbon to remain in planar contact with said labels until said ink ribbon reaches a point closer to the point "b" than to the point "a", said fourth means comprising a non-powered guide contacting the second side of said ink ribbon downstream of said thermal head, said ink ribbon passing around said non-powered guide and thereafter diverging away from said ground paper.

2. A label printer as recited in claim 1 wherein said non-powered guide comprises a guide roller.

3. A label printer as recited in claim 1 wherein said non-powered guide is made from a charge eliminating material.

4. A label printer as recited in claim 1 wherein said non-powered guide is made from metal containing carbon.

5. A label printer as recited in claim 1 wherein said separating plate is curved.

6. A label printer as recited in claim 1 wherein said separating plate has a peeling part.

* * * * *